United States Patent [19]

Spies

[11] 4,430,953

[45] Feb. 14, 1984

[54] SEWING MACHINE NEEDLE DRIVE MECHANISM

[76] Inventor: Henry J. Spies, P.O. Box 384, Station "B", London, Ontario, Canada, N6A 4W1

[21] Appl. No.: 237,583

[22] Filed: Feb. 24, 1981

[51] Int. Cl.[3] ..... D05B 1/10; D05B 55/10; D05B 55/14

[52] U.S. Cl. ..... 112/165; 112/221

[58] Field of Search ..... 112/165, 197, 221

[56] References Cited

U.S. PATENT DOCUMENTS

| | | | |
|---|---|---|---|
| 250,990 | 12/1881 | Smyth | 112/165 UX |
| 2,043,063 | 6/1936 | Ross et al. | 112/197 X |
| 2,058,271 | 10/1936 | Taubert | 112/165 |
| 4,100,867 | 7/1978 | Bass et al. | 112/221 X |

FOREIGN PATENT DOCUMENTS

| | | | |
|---|---|---|---|
| 1243447 | 9/1960 | France | 112/221 |

*Primary Examiner*—Wm. Carter Reynolds
*Attorney, Agent, or Firm*—Berman, Aisenberg & Platt

[57] ABSTRACT

A mechanism for driving needles of a sewing machine to produce for example a two thread interlocked chain stitch. To a frame is mounted a pair of eccentric cams for rotation generally about 180° out of phase with each other about an axis, the cams having peripheral bearing surfaces of predetermined contour. The shape of the peripheral bearing surfaces of the eccentric cams and of inner and exterior bearing surfaces on circumscribing cam cage followers, and the position of edge guides positioned about the outer surface of the cam cage followers so as to bear against parts of the cam cage followers, are such as to provide relative movement and orientation of each cam cage follower in a complete cycle to permit sewing machine needles associated with the cam cage followers to stitch a chain stitch. The mechanism according to the present invention permits sewing of broad fabrics by a single head unit without a cantilever arm, since a looper, located on the opposite side of the material being sewn is not required. From a single rotary input driving shaft, relative needle movement may be achieved with exact kinematic control, using no gears, chains or timing pulleys as required on traditional, known types of sewing machine needle drive mechanisms.

11 Claims, 14 Drawing Figures

| Øi INPUT SHAFT ANGLE | Øo CAM ANGLE "o" | % OF STROKE | |
|---|---|---|---|
| 0° | 0°/180° | 50/50 | |

FIG. 9A

| | | | |
|---|---|---|---|
| 57° | 60°/215° | 0/4 | |

FIG. 9B

| | | | |
|---|---|---|---|
| 90° | 107°/253 | 37/63 | |

FIG. 9C

| | | | |
|---|---|---|---|
| 131° | 145°/290° | 96/100 | |

FIG. 9D

| | | | |
|---|---|---|---|
| 132° | 147°/306° | 100/~1 | |

FIG. 9E

SEWING MACHINE NEEDLE DRIVE MECHANISM

BACKGROUND OF THE INVENTION

The present invention relates to a needle drive mechanism for sewing machines, and more particularly to a mechanism which will permit relative movement of two sewing machine needles to stitch a fabric, for example, with a two thread interlocked chain stitch.

Sewing machines traditionally have used a mechanically driven needle, though which a stitching thread passes. Vertical movement of that needle and thread through a fabric to be stitched is coordinated with a looper device, situated below on the blind side of the fabric, to form an interlocking stitch in the fabric. This type of construction requires a relatively massive frame for the sewing machine, to ensure that, during operation, a precise positional interaction between the needle and the looper. Othewise, vibration of the machine during operation would prevent the precise interaction required between the looper and the needle. As well, the traditional cantilever structure required in such traditional sewing machines limits the application of such sewing machines to the edges of cloth. A wide cloth cannot be readily stitched in a central location.

Prior art references, showing such traditional sewing machine constructions, involving multiple needles having relative movement with respect to each other, include Taubert U.S. Pat. No. 2,058,271 issued Oct. 20, 1936, Sigoda Canadian Pat. No. 458,989 issued Aug. 16, 1949 and Noble Canadian Pat. No. 45,179 issued in September, 1887.

It is an object of the present invention to devise a drive mechanism for a multiple needle sewing machine which will enable the sewing of a stitch such as a two thread interlocking chain stitch in a fabric. It is a further object of the present invention to provide such a drive mechanism which will avoid the need for a looper or other mechanism on the other, blind side of the fabrib being sewn, thereby reducing the need for a massive frame structure and avoiding the need for a span limited cantilever construction.

SUMMARY OF THE INVENTION

According to the present invention, a mechanism for driving needles of a sewing machine is provided to produce, for example, a two thread interlocking chain stitch. To a frame is mounted an eccentric cam for rotation about an axis, the cam having a peripheral bearing surface of predetermined contour. A cam cage follower is provided circumscribing the peripheral bearing surface of the cam having inner and outer bearing surfaces. Against portions of the inner bearing surface of the cam cage follower, portions of the peripheral bearing surface of the cam bear to move the cam cage follower through a cycle as the cam rotates a revolution. Edge guide means are positioned about the outer bearing surface of the cam cage follower so as to bear against parts of the cam cage follower and thereby govern the movement of the follower. The edge guide means also govern the orientation of the cam cage follower at all stages in its cycle. A needle securing means associated with the cam cage follower maintains a sewing needle in predetermined orientation with respect to the cam cage follower. The cam cage follower is positioned with respect to the cam peripheral bearing surface and the edge guide means, so that rotation of the cam causes the cam cage follower to move in a manner which will achieve a predetermined movement and orientation of a needle secured in the needle retaining means.

For producing a chain stitch, a second, similar eccentric cam and cam cage follower arrangement is mounted to the frame for rotation about the same axis, spaced from the first eccentric cam and cam cage follower. Edge guide means are positioned about the outer surface of the second cam cage follower so as to bear against parts of the outer surfaces thereof and govern the orientation of the second cam cage follower at all stages in its cycle. Each cam cage follower is operated generally 180° out of phase with the other. The shapes and positions of the peripheral surfaces of the eccentric cams and of the inner and outer bearing surfaces on the cam cage followers, and the position of the edge guide means, are such as to provide relative movement of a sewing machine needle, secured to each cam cage follower within each needle restraining means, to cooperate with the other needle to stitch for example a two thread interlocking chain stitch.

In a preferred embodiment, the same edge guide means are provided for both cam cage followers.

The needle drive mechanism according to the present invention achieves a chain stitch in a fabric with the use of two needles, both operating on one side of the surface of the fabric, thereby avoiding the requirement of the cantilevered, massive frame inherent in standard sewing machines. The device has a high speed balanced operation, with a capacity of for example 500 to 1,000 stitches per minute. This is achieved since the two interacting machine needles each alternately act as the looper or shuttle to the other on the blind side of the work material. Thus, the mechanism permits sewing together of various plies of fabrics where the rigid short span cantilever arm of standard sewing machines is impractical and the sewing of various broad fabrics such as by a lap hem stitch, where the advantage of a single head unit without such a cantilever arm, may be desirable (e.g. air inflatable structures, covers, balloons, etc.). Moreover the mechanism of the present invention is compact, with only a few moving parts that can be readily produced in volume. No gears, chains or timing pulleys are required. Thus, a relatively economical, but very reliable construction is provided.

BRIEF DESCRIPTION OF THE DRAWINGS

These and other objects and advantages of the present invention will become apparent upon reading the following detailed description and upon referring to the drawings in which:

FIGS. 9A, 9B, 9C, 9D and 9E are schematic representations showing the relative orientations and positions of two sewing needles at consecutive times during the cycle of operation of the cam cage follower;

Figure 1:
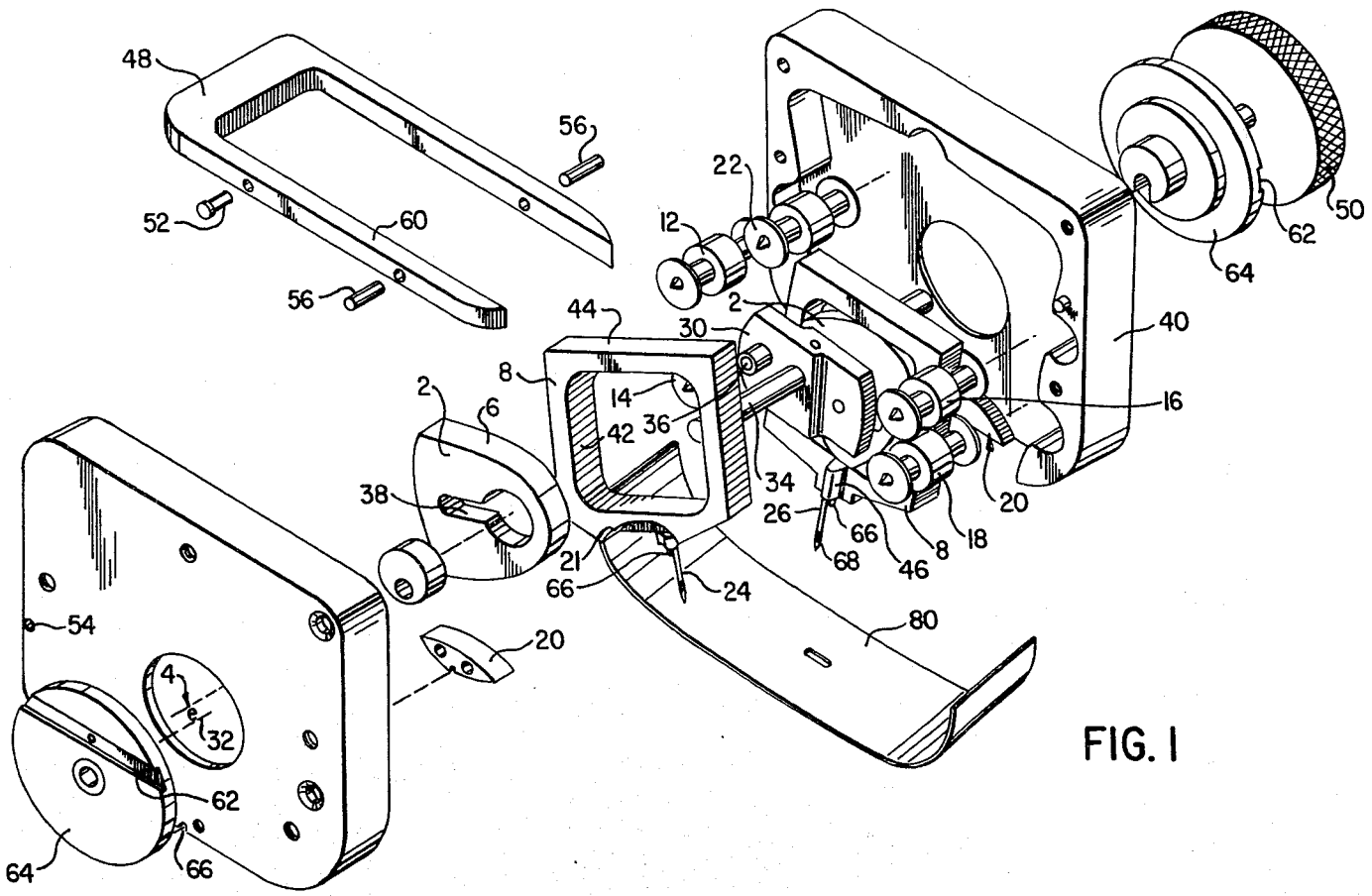
FIG. 1 is an exploded perspective view of a needle drive mechanism for making a two thread interlocking chain stitch according to the present invention.

While the invention will be described in connection with example embodiments, it will be understood that it is not intended to limit the invention to such embodiments. On the contrary, it is intended to cover all alternatives, modifications and equivalents as may be defined by the appended claims.

DETAILED DESCRIPTION OF THE INVENTION

In the drawings similar features have been given similar reference numerals.

In order to fully understand the construction and operation of mechanism of the present invention, it is worthwhile reviewing certain mathematical concepts upon which this invention is based.

Figure 2:
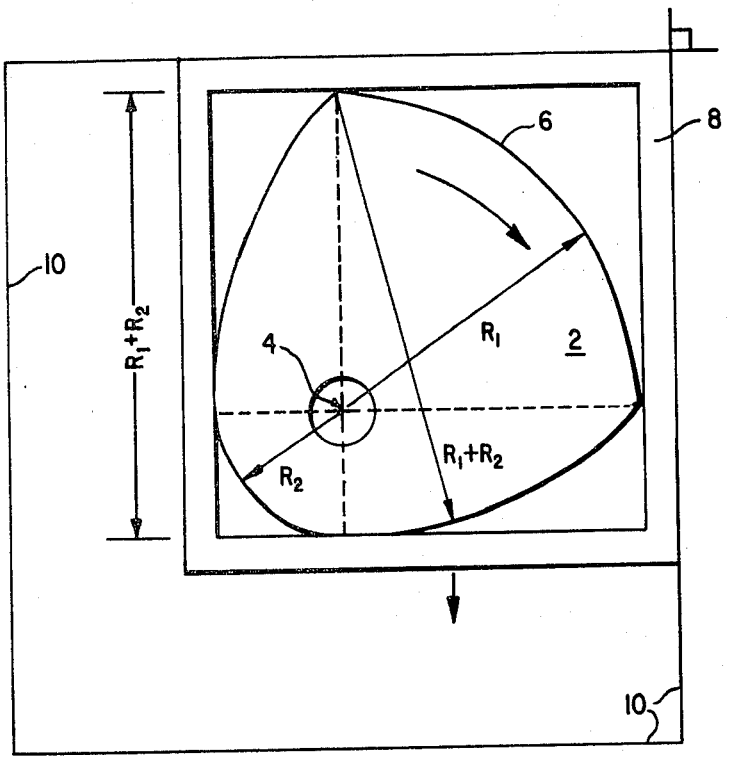
FIG. 2 is a schematic view in profile of an eccentric cam surrounded by a square cage follower to illustrate some of the mathematical principles behind the present invention.

Turning to FIG. 2, in this regard, there is illustrated an eccentric cam 2 secured to rotate about axis 4. The peripheral bearing surface 6 has an exact profile such that, when cam 2 is acting on a square cage follower 8, it will outline a square path when restricted to translation only, by appropriate edge guides 10. If the distance of translational movement of cage follower 8 in one direction is defined as S (i.e. the required stroke distance for a needle which would be secured to cage follower 8), then the profile of peripheral bearing surface 6 of cam 2 is made up of:

One 90° arc of radius $$R_1 = \frac{S}{\sqrt{2}} + S$$

One 90° arc of radius $$R_2 = \frac{S}{\sqrt{2}}$$

Two 45° arcs of radius $$R_1 + R_2 = (1 + \sqrt{2})S$$

where the axis of symmetry of the cam lies on a diagonal of the square wherein $R_1$ is a perpendicular distance between that axis and one side of that square, $R_2$ is the perpendicular distance from that axis to the opposite side of the square, and S is the distance of needle stroke in one direction if the movement of the cam cage follower were restricted to a square path.

Figure 3:
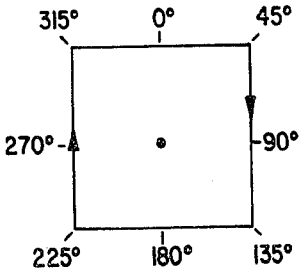
FIG. 3 is a locus of a point on in the cage follower of FIG. 2 as it moves through a cycle during one complete revolution of the cam of FIG. 2.

In the course of one complete rotation of cam 2 about axis 4, any point on square cage follower 8 will move in one cycle in the manner as indicated in FIG. 3.

Figure 4:
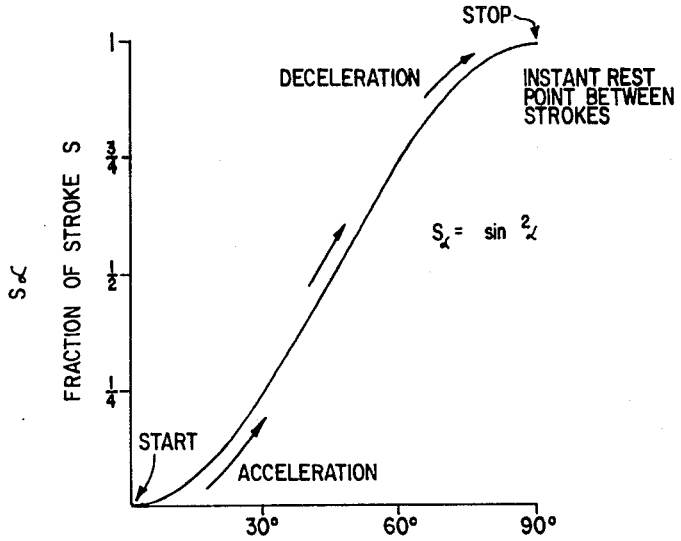
FIG. 4 is a graph plotting the distance travelled by the cage follower along each of the four 90° straight stroke edges at a given angle $\alpha$ of rotation of the eccentric cam about its axis of rotation.

By geometry the distance travelled along each of the four 90° straight stroke edges by follower 8 can be shown to be $$S_\alpha = \left[1 - \frac{\cos 2\alpha}{2}\right] = \sin^2\alpha$$

where $\alpha$ is the angle of rotation of cam 2 about axis 4 (where $\alpha$ is from 0° to 90°), and $s_{60}$ is the distance of travel of square cage follower 8 at $\alpha$. In FIG. 4 there is shown a plot of the fraction of stroke S of square cage follower 8 between an angle of rotation of cam 2 of 0° up to 90°. This plot shows the instantaneous start and stop nature of the stroke travel during $\alpha$ rotation.

By positioning two opposed edge guides at a fixed acute angle with respect to each other, and allowing for accurate rotational control of follower 8 during travel between these two straight stroke sections, the basic elements of the needle drive mechanism according to the present invention have been assembled. This arrangement is shown schematically in FIG. 5, where the opposed edge guides 10 at a fixed acute angle are provided by pairs of roller guards 12 and 14 and 16 and 18 respectively. Accurate rotational control of cam 2 during travel between these two straight stroke sections is provided by pivot guide 20 and translational and rotational roller guide 22. If a needle 24 is secured to extend below follower 8, and another needle is similarly mounted on a similar follower, spaced from but cooperating with the follower and needle illustrated in FIG. 5, in such a position that the needles appear to intersect at a fixed point in space on the blind side of a fabric to be sewn, a significant part of the theory of operation of the mechanism according to the present invention will be understood.

Figure 5:
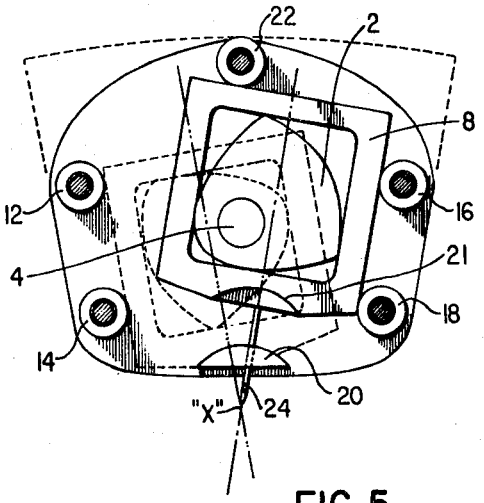
FIG. 5 is a schematic side view of a cam, cam cage follower and edge guide means according to the present invention.

In the set up illustrated in FIG. 5, the needles are to be at a 20° sewing needle intersection angle. The four roller guides 12, 14, 16 and 18 allow only exact translation of cam follower 8. The top roller guide 22 and pivot guide 20 allow only an exact rotation of 20° of cage follower 8 while the cam 2 transfers cage follower 8 from one straight stroke section to the other. At a rotational cam position of 305°, follower 8 is, for an instant, in contact with three roller guides 12, 14 and 22 at one time, and 22, 16 and 18 at the 55° position. There is a smooth transfer between strictly translational to combined and controlled rotational and translational motion, at these points, without impact or jamming. As the cam follower 8 approaches the translation roller guides 12 and 14, roller guide 22 assures that the follower 8 will be exactly parallel to them as it finishes the combined rotational and translational travel and comes to a momentary rest point, prior to starting a strictly translational downward movement. Thus this mechanism provides for movement of follower 8 as the cam rotates (with cam 2 and follower 8 movement commencing at top dead center position), as follows: rotation of about 10° and translation movement of the follower through the first 55° of the cam cycle, uni-directional, downward translation of the follower through the next 90° of cycle, rotational movement of about 20° and translation through the next 70° of cycle, unidirectional translation in an upward direction through the next 90° of cycle, and about 10° of rotation and translation through the next 55° of cycle to complete the cycle. Pivot guide 20 consists of a circle segment (with centre at the imaginary needle intersection point X) which nests into a milled out segment 21 of equal radius in the body of cam follower 8 such that from 145° to 215° of cam rotation, follower 8 is again held in rotational/translational control as it transfers between the two straight strokes. (It might be noted that the illustration of FIG. 5 is drawn to scale for a stroke of 15 millimeters which is suitable for standard 16×257 industrial sewing machine needles with shortened shanks.)

Figure 6:
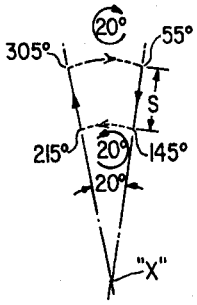
FIG. 6 represents a plot of the locus of a point in the centre of the cage follower of FIG. 4.

FIG. 6 illustrates the locus of a point, for example in the centre of the follower cage, throughout a cycle of movement of follower 8 for a complete rotation of cam 2 of FIG. 5.

Geometric analysis will show that the cam follower will be slightly lifted from the circle segment near the 180° cam rotation position. This, for the angle $\theta$ between sewing machine needles at their point of intersection of 20°, results in a slight lifting of 4.3% of the distance of stroke S. Any slight errant rotation at play is however cancelled out as the segments come in firm contact again as they approach the 215° rotational position.

The distance from the centre of cam rotation to the intersection point is:

$$\frac{S}{2\sin\frac{\theta}{2}}$$

To have two rigidly connected cams operating such that the associated cam cage followers are 180° out of phase with each other in their revolutions mounted on a single rotating shaft is not a practical drive system for the interacting needles according to the present invention for two reasons:

(1) at the common point of intersection onto the needles at 90°/270° symmetry, there is only an upper travel of 33% (where $\theta=20°$) while lower travel beyond the intersection point will take up 67% of the total stroke distance S; and (2) the cam torque required during the lower portion of travel, for stitching and cloth advance, is higher than the upper portion where the needle simply advances to the next stitch positioning. Such higher torque is not provided with such an arrangement of cams rotating on the same axis.

In order to bias this point of symmetry of the needles at their apparent intersection point downwardly closer to the 180° cam rotation point (110°/250° for example), elliptical gearing consisting of two sets of gears might be used.

Figure 7:
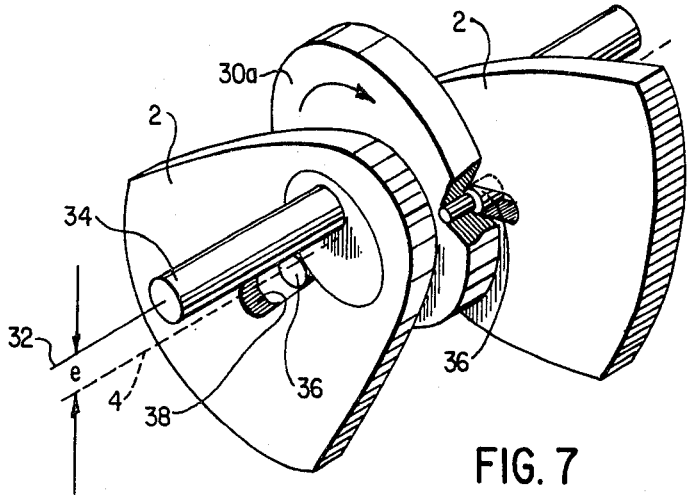
FIG. 7 is a detail view in perspective of a pair of eccentric cams driven by means of a drive disc, an alternative embodiment of a drive disc being illustrated.

However, due to its simplicity, low cost, high efficiency and design flexibility, a preferred method to achieve this end is with cyclic leverage. A drive disc 30, which rotates about an axis of rotation 32 on drive shaft 34 is provided. As can be seen in FIG. 7, drive disc 30 is between and faces the two eccentric cams, and has a cam roller 36 secured on each side, each cam roller radially spaced the same distance from axis 32 and seated within a radial slot 38 in each eccentric cam 2. Drive shaft rotation axis 32 and the axis of rotation 4 of each of cams 2 are parallel but offset a predetermined distance "e" (which is expressed as a fraction of the distance between axis 4 and the center of cam rollers 36). From plane geometry, the relationship between the rotation of drive shaft 34 and that of cams 2 about their centers of rotation can be calculated if we give a value to "e" (e.g. 0.3, 0.4 etc.). The leverage applied by cam rollers 36 on the respective cams 2 may also be determined, and will vary greatly during one cam revolution, depending upon where the cam roller is located as it rotates, with respect to axis 4 of cam 2.

Figure 8:
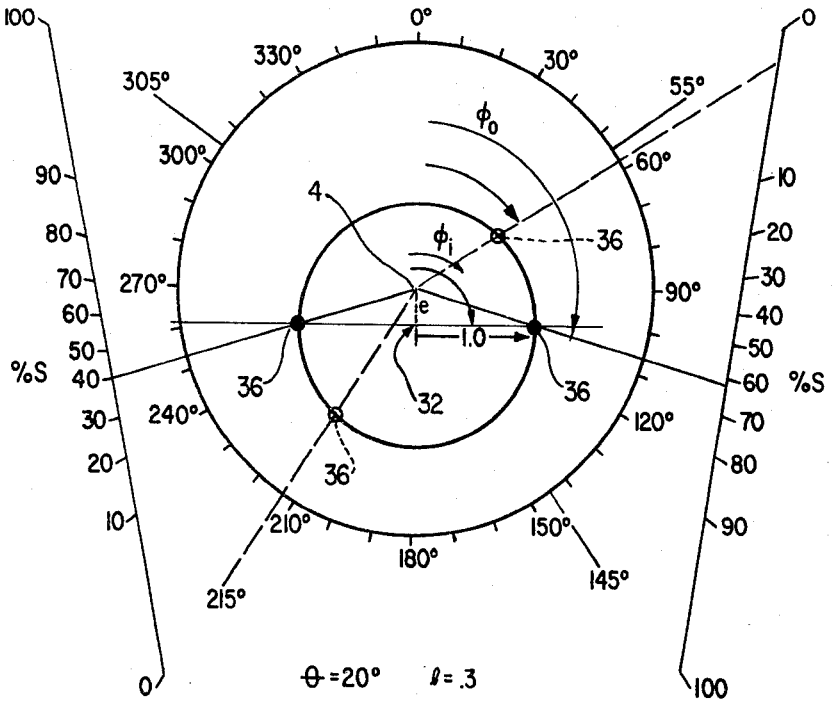
FIG. 8 is a nomograph illustrating the kinematics of the mechanism according to the present invention.

FIG. 8 represents a nomograph of the kinematics of such a cyclic leverage system where $\theta$ is 20°. The geometry of the system illustrated in FIG. 7 is defined by the formula:

$$\phi_o = \phi_i + \text{ARCTAN}\left(\frac{e\sin\phi_i}{1 - e\cos\phi_i}\right)$$

where e as previously defined, $\phi_o$ is the angle of rotation of the cam 2 about axis 4, and $\phi_i$ is the angle of rotation of the drive shaft 34. In understanding the nomograph of FIG. 8, the following definitions are useful:

Intersection travel—the percentage of stroke S travelled from the start above the fabric to the point of symmetrical intersection of the needles Downstroke—the percentage of the stroke past the intersection point to the end of the stroke Maximum Upper Stroke—the maximum percentage of stroke travel from the point where the needle can penetrate the work material (when the opposed follower 8 is on the translation track) to the point of intersection of the needles.

Minimum Upper Clearance—the clearance between the start of the stroke and the point where the upper stroke can commence.

Using the nomograph of FIG. 8, which has been set up for an angle of 20° between two needles at the point X of apparent intersection, the intersection travel, downstroke, maximum upper stroke and minimum upper clearance have been calculated for differing values of e, as set out in Table A below. It will be seen from Table A that a preferred value of e is about 0.3, this value providing a maximum upper stroke which has been almost doubled over the case when e is equal to 0 (i.e. axis 4 and drive shaft 34 having the same axis of rotation), and the excessive lower stroke when e is equal to 0 has been reduced almost by a half. In addition, a suitable percentage of minimum upper clearance is provided before the needle can penetrate the working material.

TABLE A

Representative percentage of stroke values for double needle system where $\phi$ is equal to 20°.

| e | Intersection travel % | Down Stroke % | Maximum Upper Stroke % | Minimum Upper Clearance % |
|---|---|---|---|---|
| 0 | 33 | 67 | 33 | — |
| .1 | 43 | 57 | 43 | — |
| .2 | 54 | 46 | 54 | — |
| .3 | 62 | 38 | 60 | 2 |

Turning to the nomograph of FIG. 8, the value of "e" determines the center of the larger circle (cam axis of rotation 4) with respect to the center of the smaller circle (drive shaft axis of rotation 32)—the centres of cam rollers 36 define the circumference of this smaller circle, and appear at opposite ends of the diameters thereof (the rollers being 180° out of phase). The location of rollers 36 defines the point of angular rotation of drive shaft 34 and, by joining the centre 4 of the larger circle with each of these roller 36 locations, $\phi_o$ lines are formed which pass through (1) the circumference of the larger circle to define the corresponding cam 2, and (2)

the outer straight line to define the percentage of needle stroke represented by that degree of angular rotation of the cam. In the nomograph, set up for $\theta=20°$ and $e=0.3$, it can be seen that at an angular rotation of drive shaft 34 of 90° and 270°, the cams will be at an angular rotation of about 105° and 255° respectively, and the needles will be at positions representing respectively about 62% and 38% of their strokes.

Thus, it can be seen from the above, it is possible to achieve a desired degree of clearance for the sewing machine needles above the fabric or work material, by offsetting input drive shaft 34 below the cam shaft centers of rotation so that approximately $e=0.3$.

OTHER FORMULAS OF INTEREST INCLUDE

To have full ability to use and design a mechanism according to the present invention, other mathmatical formulas of interest are:

(1) DOWNWARD NEEDLE STROKE ANGLE $$\alpha_{\downarrow} = \phi_o - \left(\frac{\pi}{4} + \frac{\theta}{2}\right)$$

(2) UPWARD STROKE ANGLE $$\alpha_{\uparrow} = \phi_o - \left(\frac{5\pi}{4} + \frac{\theta}{2}\right)$$

where $\alpha$ is the angle during the needle stroke cycle, $\theta$ is the fixed sewing angle, and $\phi_o$ is as previously defined, and $$0° \leqq \alpha \leqq 90°$$

(3) The distance from the centre of the square cage follower to the symmetrical point of intersection on the needles is:

$$S\left[\frac{1}{2\tan\frac{\theta}{2}} + \tfrac{1}{2} - \sin^2\left(\frac{\pi}{4} - \frac{\theta}{2} + \text{ARCTAN}\, e\right)\right]$$

where and e are as previously defined.

(4) The slight lift above the lower circle segment pivot guide experienced by the square cage follower at $\phi_o$ 180° is:

$$\frac{S}{2}\tan\frac{\theta}{4}$$

(i.e. if $\theta=20$, the lift is 4.3% of S.)

(5) The distance from the centre of cam rotation to the point of intersection of the needles is:

$$\frac{S}{2\sin\frac{\theta}{2}}$$

In FIG. 9 are illustrated needle positions at various input rotations, where S is equal to 15 mm, $\theta$ is equal to 20° and e is equal to 0.3. The distance from the needle point to the common intersection point on the needle is 3 mm.

TABLE B

| Angle of Rotation of Drive Shaft | Angle of Rotation of Cam | Percentage of Stroke |
|---|---|---|
| 0° | 0°/180° | 50%/50% |
| 57° | 60°/215° | ↑ 0%/4% ↓ |
| 90° | 107°/253° | ↑ 37%/63% ↓ |
| 131° | 145°/298° | ↑ 96%/100% ↓ |
| 132° | 147°/306° | ↑ 100%/~1% |

The information set out in Table B is graphically illustrated in FIGS. 9A, 9B, 9C, 9D and 9E. in FIG. 9A, the horizontal lines in the right hand column represent a maximum cloth height for the maximum stitch length (i.e. about 2 mm. for this configuration). In FIG. 9D, the left hand needle 24 has cleared the working cloth or material while the right hand, needle 26 is at a momentary stop position. In FIG. 9E, needle 24 is entirely above the surface of the cloth or working material.

The inter-relationship and operating construction of the needle drive mechanism according to the present invention may be more fully understood by referring to FIG. 1. Two eccentric cams 2 are mounted within corresponding square cage followers 8 and secured to frame 40. Cams 2 are intended to rotate about axis 4 within respective square cage followers 8. The cams 2 have a peripheral bearing surface 6 of predetermined contour, determined mathematically as hereinbefore described. The cam cage followers 8 have inner contoured bearing surfaces 42 of generally square shape, circumscribing the peripheral bearing surfaces 6 of their corresponding cams 2. Portions of the peripheral bearing surface 6 of each cam 2 bear against portions of the inner bearing surface of the corresponding follower 8 to move the cam cage follower 8 through a cycle as the cam 2 rotates a revolution. It will be understood, with respect to the inner bearing surfaces 42, that the corner radii may be S/2 or less without interferring with cam rotation (S being as hereinbefore defined). Cam cage followers 8 have also outer, circumscribing bearing surfaces 44. Edge guide means 10, comprising roller guide pairs 12 and 14 and 16 and 18, as well as pivot guide 20 and translational and rotational roller guide 22, are positioned about the outer surface 44 of each cam cage follower so as to bear against parts of the outer surface thereof and govern the orientation of the cam cage followers 8 at all stages of their cycle. Inner bearing surface 42 and outer bearing surface 44 of follower 8 are contoured and positioned with respect to the cam peripheral bearing surfaces 6 and edge guide means 10 such that rotation of cams 2 cause their corresponding cage followers to move in a manner which will achieve relative movement of needles 24 and 26 secured in needle restraining means 46 associated with each follower 8, to permit needles 24 and 26 to stitch a double thread locking chain stitch in a work material. Drive disc 30 is also secured within frame 40 to rotate about drive shaft 34, drive shaft 34 being powered by appropriate means associated with the sewing machine. Cam rollers 36, secured to drive disc 30, are seated in radial slots 38 in each cam 2, the rollers and slots of the cams being positioned to ensure that each cam rotates appropriately out of phase (e.g. oscillating about the mean 180° out of phase position) with the other cam.

As can be seen in FIG. 7, axis of rotation 4 for cams 2 is offset with respect to the axis of rotation 32 of drive shaft 34, preferably a distance of about e=0.3 (where "e" is as hereinbefore defined). As well, roller guide pairs 12 and 14 and 16 and 18 are positioned within frame 40 in such a way that the angle between the needles at their point of intersection is about 20°. Drive disc 30*a* is shown in FIG. 7 as being of circular shape, unlike the oblong shape of drive disc 30 of FIG. 1. The drive discs need not be of identical shape from one unit to the next.

As can be seen in FIG. 1, a U-frame lever 48 is also provided to enable lifting of needles 24 and 26 to clear simultaneously the upper surface of the working material. This lever allows rotation of drive shaft 34 180° about to to a position so that the drive shaft center is in line with, but outside of the center of rotation of cams 2 and the sewing needle apparent intersection point X. In this position of shaft 34, both needles can be completely withdrawn by adjusting $\phi_i$ to 90°/270° using manual adjustment wheel 50 which is secured to drive shaft 34. In this manner, cloth may be moved into position prior to sewing and removed upon completion. Rotation locking pin 52 is slidably secured in lever 48 to fit into hole 54 in the side of frame 40. Lever 48 pivots about locking dowels 56, lever arms 60 being sitted in slots 62 on drive shaft bearing housings 64.

By pivoting lever 48 180° about axis 4, once the drive shaft has been adjusted to the 90°/270° position, the axis of rotation 32 will be swung above axis 4 a similar distance e as illustrated in the nomograph of FIG. 8. As can be readily calculated from the nomograph, the needles will be raised to a point of about 10% of their full stroke, thereby being clearly withdrawn above the surface of the working material (i.e. having a designed 10% upper clearance).

Figure 10:
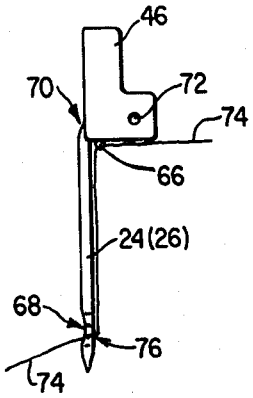
FIG. 10 is a side view of a needle and needle securing means according to the present invention.

It will be understood that needles 24 and 26, being secured to different followers 8, operate with an axial clearance which, as can be seen from FIG. 10, is provided by the width of drive disc 30 and the profile of rollers 12, 14, 16, 18 and 22. (This distance in a working model may be, for example, 6 mm). Yarn take up by the needles is simply provided for by passing the yarn through guides 66, one on the bottom of the frame 40 and the other on the bottom of the associated cam cage follower 8, prior to entering the eye of the needle. Tension control may be added to the thread supply to control the tension in the stitch. It is important that the needles during operation be axially placed such that the point of either needle passes through the scarf area 68 of the other. An example of the needle securing means 46, and needle 24(26) is illustrated in FIG. 10. A recessed area 70 is provided in the body of other securing means 46 and shank of needle 24(26) so that reciprocal needle clearance is achieved during operation. Yarn uptake guide 66, in this embodiment is positioned right on securing means 46, as shown, securing means 46 being itself attached to cam cage follower 8 with the aid of mounting hole 72. The thread 74 passes the yarn guide 66 prior to entering the eye 76 of needle 24(26).

In operation, the tip of one needle hooks a loop of thread by passing through the scarf area of the other needle, this action taking place on the blind side of the cloth or working material.

There are various other factors which may be mentioned in the design of an operating sewing machine using the needle drive mechanism of the present invention. For instance, at the maximum stitch length for the unit there must still exist a slight clearance between the needle tip and the fabric so that the needle may advance to the next stroke position without catching the cloth (approximately 10% of the stroke is the desired operating range).

When a needle is fully extended downwards (the positions of FIGS. 9*b* and 9*c*) and is about to move upwards, there must be sufficient upwards travel to form a reliable loop that the downward needle can catch. Factors such as needle size, sewing angle, maximum cloth thickness and stroke all determine the operating stitch size range. The selected distance from the common intersection point on the needles to the tip (3 mm in the illustrated embodiment) will determine the positioning of the needle mount on cam follower 8. It will also determine where the reciprocal needle point will enter the scarf area.

One feature of the stitch produced by the needle drive mechanism of the present invention is that the stitches are of the locking type. Should the fabric become damaged, only one stitch can be pulled out. To undo the stitching, one would have to alternatively pull on both threads continuously to undo the stitching.

In operation, when sewing textiles, the fabric might be simply draped over the curved face plate 80 and tensioned slightly to allow clean penetration of the needle. Other orientations of the needle drive mechanism and fabric when in operation would of course be possible. Various attachments may be adapted to supply friction tension or ensure no fabric lifting during the needle stroke. Fabric control could be provided either manually by an operator, or by attaching attachments, rollers, etc.

In one application of a prototype of the needle drive mechanism of the present application, uni-directional strands of glass filaments have been sewn together into bands using the following parameters:

Yarn—Du Pont Kevlar 49 (Trade Mark) aramid yarn 1140 dernier prepreged with latent cure liquid epoxy resin Needles—16×257 standard industrial sewing machine needle type Stroke—15 mm.

Sewing Angle—20°

Leverage—$\alpha$0.30

The yarn supply tension was controlled by friction capstans to ensure a constant stitch tension.

Other applications of the present invention would include:

(a) sewing spans of uni-directional glass fibre (or other continuous reinforcements such as aramid and carbon fibre) cloth. In this application the sewing machine is mounted freely on a linear slide such that as it sews across the span it propells itself along. The cloth rolls may be dry or prepreged. The sewn thread in this application may be of a very high yield since its only function is to hold the band together to allow handling during lay up, and no significant tension has to be endured. For vertical applications the sewing mechanism may simply be counterbalanced.

(b) Sewing together various plies of fabrics where the rigid short span cantilever arm of standard sewing machine is impractical.

To those skilled in the art, many modifications intended to be included within the present invention will be apparent. For example, if it is desired to avoid the aforementioned rotational play in the cam followers during operation, one may incorporate rollers at the corners of the followers and provide, instead of the previously described roller and pivot guides, track edge guides, against which these rollers bear, defining two straight stroke edges and upper and lower exactly curved edges, whereby the orientation of the cam cage followers throughout their cycles is controlled so that the axes of the needles pass through point X (FIG. 5) at all times.

Because the whole kinematic system of the needle drive mechanism according to the present invention can be expressed by exact mathematical formulae, the design for a certain application can be readily set out and modified as required. The simply defined mathematics of the unit according to the present invention allows for rapid machining (e.g. cam profiles from plate, studholes and shaft positions and end plates, cam follower square cage, etc.). The invention provides an extremely effective mechanism for driving the interacting needles.

Among its main advantages are the facts that:

it requires only a single input drive shaft;

it has a fixed entry/exit needle angle in the work material, with no bending forces being exerted on the needles;

it enables exact kinematic control;

it can be designed to utilize 100% of the input stroke and thereby avoid long needles and excess needle travel;

the cyclic output leverage provided inherently allows for added torque as needed during the stitching and cloth advancing phase, while maintaining a near uniform input torque. This provides for a smooth sewing process with a small motor;

it has no gears, chains or timing pulleys;

the compact mechanism, with only a few moving parts, can be readily produced in volume;

the mechanically driven parts of the mechanism are kept on one side of the work material thereby removing the need for mechanically driven loopers, shuttles and the like on the blind side of the work material.

Thus it is apparent that there has been provided in accordance with the invention a needle drive mechanism for a sewing machine that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A needle drive mechanism for a sewing machine, comprising:

(a) a frame;

(b) an eccentric cam mounted to the frame for rotation about an axis and having a peripheral bearing surface of predetermined contour;

(c) a cam cage follower having an inner bearing surface circumscribing the peripheral bearing surface of the cam, against portions of which, inner bearing surface portions of the peripheral bearing surface bear to move the cam cage follower through a cycle as the cam rotates a revolution, the cam cage follower also having an outer bearing surface;

(d) edge guide means positioned about the outer surface of the cam cage follower to bear against parts on the surface thereof and govern the movement and orientation of the cam cage follower throughout its cycle and (e) needle securing means associated with the cam cage follower to maintain a needle in predetermined orientation with respect to the cam cage follower, the shape and position of the functional bearing surfaces on the cam cage follower being determined, and the cam cage follower being positioned with respect to the cam peripheral bearing surface and the edge guide means, such that rotation of the cam causes the cam cage follower to move in a manner which will achieve a predetermined movement and orientation of a needle secured in the needle securing means.

2. A mechanism according to claim 1, the mechanism being further provided with a second eccentric cam mounted to the frame for rotation about the same axis but spaced from the first eccentric cam and having a peripheral bearing surface of predetermined contour; a second cam cage follower having an inner bearing surface circumscribing the peripheral bearing surface of the second cam against portions of which inner bearing surface portions of the peripheral bearing surface bear to move the second cam cage follower through its cycle as the second cam rotates a revolution; needle securing means associated with the second cam cage follower to maintain a needle in predetermined orientation with respect to the second cam cage follower; and edge guide means positioned about the outer surface of the second cam cage follower so as to bear against parts on the outer surfaces thereof and govern the movement and orientation of the second cam cage follower throughout its cycle, the relative orientation of needles secured within the needle securing means being such that the needles, during operation periodically pass beside each other at a point of apparent intersection.

3. A mechanism according to claim 2 wherein the same edge guide means are provided for first and second cam cage followers.

4. A mechanism according to claim 2 wherein the mechanism is provided with a drive shaft to rotate the eccentric cams, the axis of rotation of the drive shaft being parallel to but offset from the axis of rotation of the cams.

5. A mechanism according to claim 4 wherein the motion of each cam cage follower is generally 180° out of phase with the movement of the other, and the contours and positions of the peripheral surfaces of the eccentric cams, and of the inner and outer bearing surfaces of the cam cage followers, and the position of the edge guide means, are such as to provide relative movement of each cam cage follower through a complete cycle to permit a sewing machine needle secured within each needle restraining means to cooperate with the other needle to stitch a double thread chain stitch in a work material.

6. A mechanism according to claim 5 wherein the inner bearing surfaces of the cam cage follower generally define a square, and wherein the peripheral bearing surface of the cam has a profile consisting of one 90° arc of radius $$R_1 = \frac{S}{\sqrt{2}} + S,$$

one 90° arc of radius $$R_2 = \frac{S}{\sqrt{2}},$$

and two 45° arcs of radius $$R_1 + R_2 = (1 + \sqrt{2})S.$$

where the axis of symmetry of the cam lies on a diagonal of the square wherein $R_1$ is a perpendicular distance between that axis and one side of that square, $R_2$ is the perpendicular distance from that axis to the opposite side of the square, and S is the distance of needle stroke in one direction if the movement of the cam cage follower were restricted to a square path.

7. A mechanism according to claim 6 wherein the cams are rotated by means of rollers rigidly associated with the drive shaft and radially spaced the same distance from the axis of rotation thereof, a roller being seated within a radial slot in each cam body.

8. A mechanism according to claim 7 wherein the axial offset between the axis of rotation of the drive shaft and the axis of rotation of the cam, expressed as a fraction of the distance between the center of the rollers and the axis of rotation of the drive shaft, is about 0.3.

9. A mechanism according to claim 6 wherein the edge guide means comprises a plurality of bearing surfaces secured to the frame and positioned with respect to the external bearing surface of the cam cage followers to sequentially contact portions of the external bearing surfaces of each cam cage follower during operation to produce the desired motion and orientation of the cam cage followers.

10. A mechanism according to claim 9 wherein for a particular orientation of the mechanism, the edge guide means are positioned to produce the rotation of about 10° and translation movement through the first 55° of the cycle, uni-directional, downward translation through the next 90° of cycle, rotational movement of about 20° and translation through the next 70° of cycle, uni-directional translation in an upward direction through the next 90° of cycle, and about 10° of rotation and translation through the next 55° of cycle to complete the cycle.

11. A mechanism according to claim 5 further comprising a U-frame lever mechanically connected to the drive shaft bearing housing to allow rotation of the eccentric drive shaft 180° about the cam shaft axis of rotation to a position so that the drive shaft center is line with, but outside of the center of rotation of the cams and the apparent intersection point of the needles, whereby both needles can be completely withdrawn above the surface of the working material.

* * * * *